US009744536B2

(12) United States Patent
Visby-Kjærgaard et al.

(10) Patent No.: US 9,744,536 B2
(45) Date of Patent: Aug. 29, 2017

(54) ROLLER PRESS

(71) Applicant: FLSmidth A/S, Valby (DK)

(72) Inventors: Karsten Visby-Kjærgaard, Aalborg Ø (DK); Claus Linding Olesen, Svenstrup J (DK); Mads Peter Rasmussen, Fårup (DK); Nick Paw Bennedsen, Hadsund (DK)

(73) Assignee: FLSmidth A/S (DK)

( * ) Notice: Subject to any disclaimer, the term of this patent is extended or adjusted under 35 U.S.C. 154(b) by 236 days.

(21) Appl. No.: 14/763,848

(22) PCT Filed: Feb. 4, 2014

(86) PCT No.: PCT/DK2014/050025
§ 371 (c)(1),
(2) Date: Jul. 28, 2015

(87) PCT Pub. No.: WO2014/117783
PCT Pub. Date: Aug. 7, 2014

(65) Prior Publication Data

US 2015/0360229 A1 Dec. 17, 2015

(30) Foreign Application Priority Data

Feb. 4, 2013 (DK) ..... 2013 70060

(51) Int. Cl.
*B02C 4/00* (2006.01)
*B02C 4/28* (2006.01)
*B02C 4/02* (2006.01)

(52) U.S. Cl.
CPC ..... *B02C 4/283* (2013.01); *B02C 4/02* (2013.01)

(58) Field of Classification Search
CPC ..... B02C 4/02; B02C 4/283
(Continued)

(56) References Cited

U.S. PATENT DOCUMENTS 813,320 A 2/1906 Neumann
8,066,215 B2 * 11/2011 Demuth ..... B02C 4/283 241/294
2010/0200686 A1 * 8/2010 Demuth ..... B02C 4/30 241/230

FOREIGN PATENT DOCUMENTS

CN 102172544 A 9/2011
DE 19904037816 A1 6/1992
(Continued)

OTHER PUBLICATIONS

The International Search Report and Written Opinion dated Apr. 15, 2014, 8 pages.

*Primary Examiner* — Faye Francis
(74) *Attorney, Agent, or Firm* — Matthew R. Weaver

(57) ABSTRACT

A roller press (1) is described for grinding of particulate material such as cement raw materials, cement clinker and similar materials, which roller press (1) comprises two oppositely rotating rollers (2, 3) forming between them a roller gap (4) and a co-rotating annular disc (5), which in concentric manner is attached to an end surface (6, 7) of one of the rollers (2) by means of a number of resilient attachment elements (8) and being movable in the direction of the roller axis, where the outer diameter of said annular disc (5) is greater than the diameter of said one of the rollers (2), hence the annular disc (5) in the area of the roller gap (4) extends toward the other roller (3), thus covering at least part of the roller gap (4). The roller press (1) is peculiar in that the inner diameter of the annular disc (5) is smaller than the diameter of the roller (2), to which it is attached, thus overlapping the end surface (6, 7) of said roller (2), and that the resilient attachment elements (8) are evenly distributed over the circumference of the annular disc (5) and provided with spaces or openings (10) there between.
It is hereby obtained that the annular disc (5) does not get stuck by material to be grinded or destructive forces dam-
(Continued)

aging construction parts are not accumulated. This is due to the fact that material in the roller press (1) according to the invention is allowed to escape from the area between the annular disc (5) and the roller (2) to which it is attached.

8 Claims, 1 Drawing Sheet

(58) Field of Classification Search
USPC ..... 241/226
See application file for complete search history.

(56) References Cited

FOREIGN PATENT DOCUMENTS

| | | | |
|---|---|---|---|
| EP | 2167234 | A1 | 3/2010 |
| WO | 2012031324 | A1 | 3/2012 |

* cited by examiner

FIG. 1
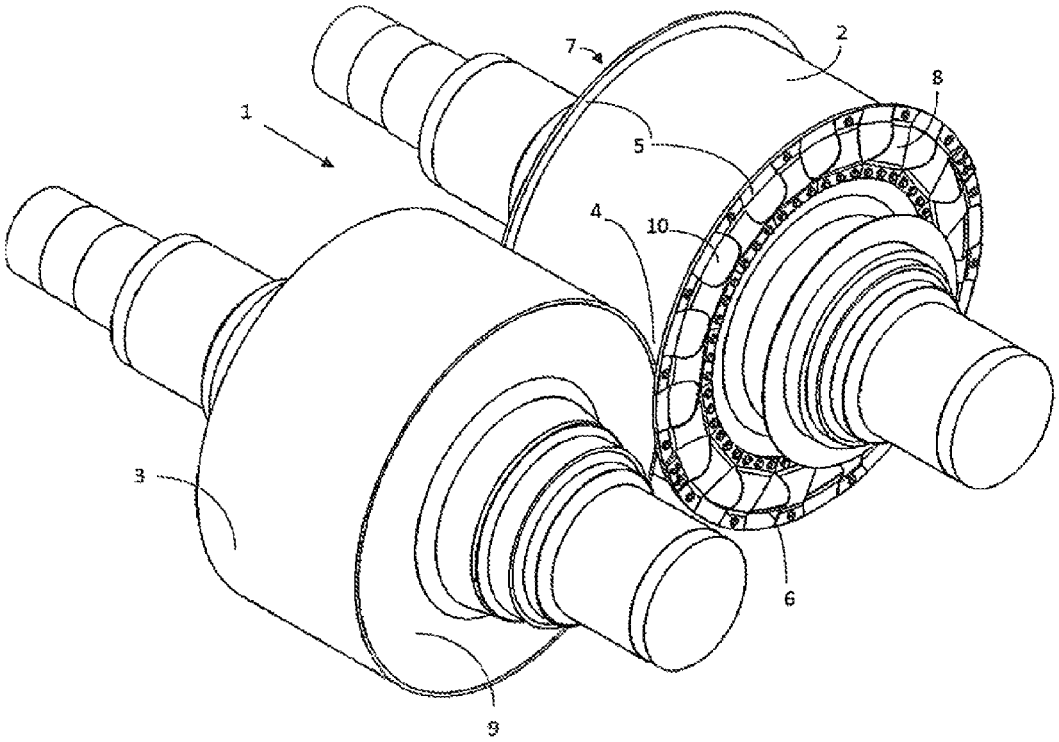
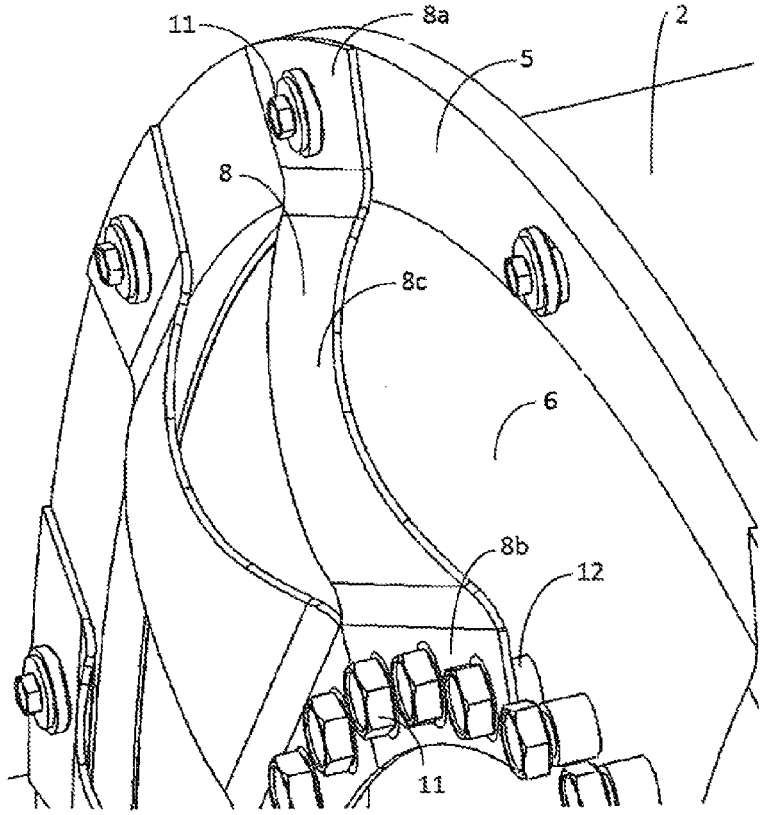
FIG. 2

ROLLER PRESS

The present invention relates to a roller press for grinding of particulate material such as cement raw materials, cement clinker and similar materials, which roller press comprises two oppositely rotating rollers forming between them a roller gap and a co-rotating annular disc, which in concentric manner is attached to an end surface of one of the rollers by means of a number of resilient attachment elements and being movable in the direction of the roller axis, where the outer diameter of said annular disc is greater than the diameter of said one of the rollers, hence the annular disc in the area of the roller gap extends toward the other roller, thus covering at least part of the roller gap.

A roller press of the aforementioned kind is known from DE 40 37 816 A1, and may for example be used for grinding particulate material. Here, use is made of an annular disc to restrict and cover the roller gap at the ends of the rollers in order to limit the flow of material which is laterally discharged at the ends of the rollers during the operation of the roller press. In this known roller press the annular disc surrounds one of the rollers and overlaps the other. Further, it is spring-loaded so as to allow minor axial movements in instances where, for example, material particles which are hard and difficult to grind penetrate the area between the annular disc and the rollers or in instances where one of the rollers is in an inclined position relative to the other roller. One disadvantage of this known roller press is that there is a high risk that material due to the rather complex construction can build up in the area where the annular disc meets the roller to which it is attached and even be squeezed in between these elements; hence the annular disc gets stuck. Furthermore, material can settle on the spring windings so that the axial movement of the annular disc is essentially restricted. Due to the large overlap between the annular disc and the opposite roller end surface there will be a high risk that extensive wear will occur in this area.

Another roller press is known from EP 2167234-B1. In this embodiment the annular disc is segmented in sections over its circumference, each of which is very complex and consists of many parts. The construction is closed in the sense that material escaping from the roller gap may be captured in the space between the roller end surface and the disc sections, where it may build up until so large forces occur that the bolt holding the disc sections or other critical parts are broken.

It is the objective of the present invention to provide a roller press by means of which the aforementioned disadvantages are eliminated.

This is achieved by a roller press of the kind mentioned in the introduction and being is characterized in that the inner diameter of the annular disc is smaller than the diameter of the roller, to which it is attached, thus overlapping the end surface of said roller, and that the resilient attachment elements are evenly distributed over the circumference of the annular disc and provided with spaces or openings there between.

It is hereby obtained that the annular disc does not get stuck by material to be grinded or destructive forces damaging construction parts are not accumulated. This is due to the fact that material in the roller press according to the invention is allowed to escape from the area between the annular disc and the roller to which it is attached. Thus, by providing the annular disc in such a way that it overlaps the end surface of the roller to which it is attached, the annular disc is effectively prevented from entering into the roller gap and getting stuck there. Further, when a force created by the material being treated in the roller press and acting in the axial direction towards the annular disc, the annular disc is freely allowed to move away from the roller end until said force equals the reaction force created by the resilient attachment elements in the opposite direction. Hereby, a relatively small annular gap is formed between the annular disc and the roller end surface, which annular gap allows material to flow away from the roller gap, thereby preventing the force acting on the resilient attachment elements to exceed what they are dimensioned to withstand. In addition, by providing the resilient attachment elements with spaces or openings there between, the material flowing from the roller gap through the annular gap is allowed to flow away from these elements, thereby preventing malfunction of these.

The resilient attachment elements provide the attachment of the annular disc to the roller end surface and are each in one end secured to the annular disc and in the other end to the roller end surface by means of appropriate fastening means, such as bolts.

The resilient attachment elements may in principle have any suitable form and be made of any suitable material that fulfils the overall requirements in terms of resiliency and durability. However, it is preferred that the resilient attachment elements are made of spring steel. It is further preferred that they have the form of sheets or bars, which in a simple embodiment may be essentially plane. However, in order to reduce the longitudinal tensions in the resilient attachment elements when the annular disc is forced in the axial direction away from the roller end and in order to increase the space between the resilient attachment elements and the roller end surface, thus reducing the risk of clogging of material in this area, the resilient attachment elements are preferably provided with a middle section having an outwardly curved or circular form.

The resilient attachment elements may be secured directly to the roller end surface by means of bolts, however it is preferred that the resilient attachment elements are mounted in a distance from the roller end surface by means of a number of spacing bushes or equivalent. In this way the centre of rotation of each resilient attachment element is moved away from the roller end surface, thus enabling adjustment of the pre-stressing in the resilient attachment elements and providing passageways for the material to flow out instead of building up.

In order to lock the resilient attachment elements in the circumferential direction, each of the resilient attachment elements is in its end, which is secured to the roller end surface, dimensioned so that it abuts the adjacent elements. For ease of manufacture of the resilient attachment elements are preferably of like configuration.

In a preferred embodiment of the roller press according to the invention the outer diameter of the annular disc is dimensioned to ensure that the annular disc in the area of the roller gap under normal operation of the roller press overlaps also an end surface of said other roller, thus covering the whole roller gap.

The invention will now be described in further details with reference to the attached drawing, being diagrammatical, and where FIG. 1 shows in perspective a section of a roller press, and FIG. 2 shows details of the roller press illustrated in FIG. 1.

FIG. 1 shows a roller press 1 which comprises two oppositely rotating rollers 2, 3 forming between them a roller gap 4. At both axial ends of one of the rollers 2 the roller press 1 further comprises a co-rotating annular disc 5, which is concentrically attached to an end surface 6, 7 of said roller 2 by means of a number of resilient attachment elements 8 and being movable in the direction of the roller axis. The outer diameter of both annular discs 5 is dimensioned to ensure that the annular discs 5 in the area of the roller gap 4 under normal operation of the roller press 1 overlaps an end surface 9 of the other roller 3, thus covering the whole roller gap 4 at both axial ends of the roller press 1.

In order to ensure that the annular discs 5 do not get stuck by material to be grinded or destructive forces damaging construction parts are not accumulated it is suggested according to the invention that the inner diameter of the annular discs 5 is smaller than the diameter of the roller 2, to which they are attached, thus overlapping the respective end surfaces 6, 7 of said roller 2, and that the resilient attachment elements 8 are evenly distributed over the circumference of the annular discs 5 and provided with spaces or openings 10 there between.

Thus, during operation the annular discs 5 are effectively prevented from entering into the roller gap 4 and getting stuck there. Further, when the material being treated in the roller press presses against the annular discs 5, they will move away from the roller end, thereby forming in both ends of the roller press 1 a relatively small annular gap between the respective annular disc 5 and the roller end surface 6, 7, allowing material to flow away from the roller gap. In this way, the force acting on the resilient attachment elements 8 is prevented from exceeding what they are dimensioned to withstand. The spaces or openings 10 provided between the resilient attachment elements 8 allow the material flowing from the roller gap 4 through the annular gap to flow away from these elements, thereby preventing malfunction of these.

FIG. 2 shows a preferred embodiment of the resilient attachment element 8. As can be seen in the FIG. 2 the resilient attachment element 8 is in one of its ends 8*a* secured to the annular disc 5 and in the other end 8*b* to the roller end surface 6 by means of bolts 11.

The resilient attachment elements 8 are made of spring steel and have the form of sheets, which are provided with a middle section 8*c* having an outwardly curved form. Further, as seen in FIG. 2, each resilient attachment element 8 is mounted in a distance from the roller end surface 6 by means of a spacing bush 12, thus the centre of rotation of each resilient attachment element 8 is positioned a distance away from the roller end surface 6, thus reducing the stresses in the resilient attachment elements 8 and providing passageways between the bushes 12 for the material to flow out.

As shown in FIG. 1 all the resilient attachment elements 8 are of like configuration, and are further in their ends 8*b*, which is secured to the roller end surface 6, dimensioned so that they abut one another, hence locking the resilient attachment elements 8 in the circumferential direction.

The invention claimed is:

1. A roller press for grinding particulate material, the roller press comprising:

first and second oppositely rotating rollers, one of the first and second rollers mounted so as to be movable relative to the other of the first and second rollers, the rollers forming a roller gap there between;

a co-rotating annular disc concentrically attached to an end surface of the first roller directly by a plurality of resilient attachment elements, the annular disc mounted so as to be movable in the direction of a roller axis;

wherein an outer diameter of the annular disc is greater than an outer diameter of the first roller, such that the annular disc in the area of the roller gap covers at least part of the roller gap;

wherein an inner diameter of the annular disc is smaller than the diameter of the first roller such that the annular disc overlaps the end surface of the first roller;

wherein the plurality of resilient attachment elements are evenly distributed over the circumference of the annular disc; and wherein the plurality of resilient attachment elements are provided with spaces or openings there between.

2. A roller press according to claim 1, wherein the plurality of resilient attachment elements comprise a first end and second end, the first end being secured to the annular disc by a fastening means and the second end being secured to the end surface of the first roller by the fastening means.

3. A roller press according to claim 1, wherein the plurality of resilient attachment elements are comprised of spring steel.

4. A roller press according to claim 1, wherein the plurality of resilient attachment elements have the form of sheets.

5. A roller press according to claim 1, wherein the plurality of resilient attachment elements are comprised of a middle section having an outwardly curved form.

6. A roller press according to claim 1, wherein the resilient attachment elements are mounted at a distance from the end surface of the first roller by bushing.

7. A roller press according to claim 2, wherein the second end is dimensioned such that each resilient attachment element abuts an adjacent resilient attachment element.

8. A roller press according to claim 1, wherein the outer diameter of the annular disc is dimensioned such that the annular disc in the area of the roller gap overlaps an end surface of the second roller.

* * * * *